US009095757B2

(12) United States Patent
Corbett

(10) Patent No.: US 9,095,757 B2
(45) Date of Patent: Aug. 4, 2015

(54) APPARATUS FOR A LIGHTWEIGHT PUNCHING BAG

(76) Inventor: Brian J Corbett, Reading, MA (US)

( * ) Notice: Subject to any disclaimer, the term of this patent is extended or adjusted under 35 U.S.C. 154(b) by 121 days.

(21) Appl. No.: 12/954,866

(22) Filed: Nov. 27, 2010

(65) Prior Publication Data

US 2014/0121069 A1 May 1, 2014

(51) Int. Cl.

| | |
|---|---|
| ***A63B 69/34*** | (2006.01) |
| ***A63B 69/22*** | (2006.01) |
| ***A63B 69/24*** | (2006.01) |
| ***A63B 69/20*** | (2006.01) |
| *A63B 71/02* | (2006.01) |

(52) U.S. Cl.

CPC ..... *A63B 69/208* (2013.01); *A63B 69/201* (2013.01); *A63B 69/205* (2013.01); *A63B 71/028* (2013.01); *A63B 2071/024* (2013.01); *A63B 2071/025* (2013.01)

(58) Field of Classification Search

CPC .... A63B 69/20; A63B 69/201; A63B 69/203; A63B 69/208

USPC ..... 482/83–90

See application file for complete search history.

(56) References Cited

U.S. PATENT DOCUMENTS

| | | | | |
|---|---|---|---|---|
| 1,703,012 | A * | 2/1929 | McNamara | 482/90 |
| 4,527,796 | A | 7/1985 | Critelli | |
| 4,749,185 | A | 6/1988 | Spears | |
| 4,817,941 | A * | 4/1989 | McCorry | 482/90 |
| 4,903,966 | A * | 2/1990 | Liao | 473/423 |
| 5,026,048 | A * | 6/1991 | Jones | 482/83 |
| 5,324,227 | A * | 6/1994 | Yuh-Ching | 446/473 |
| 5,330,403 | A * | 7/1994 | Kuo | 482/83 |
| 5,624,358 | A | 4/1997 | Hestilow | |
| 5,630,998 | A * | 5/1997 | Parsons | 434/11 |
| 5,700,229 | A * | 12/1997 | Karnofsky | 482/83 |
| 5,788,612 | A * | 8/1998 | Rennick | 482/83 |
| 5,792,032 | A * | 8/1998 | Williams et al. | 482/83 |
| 6,027,435 | A | 2/2000 | Nadorf et al. | |
| 6,080,089 | A | 6/2000 | Nicholson | |
| 6,106,443 | A | 8/2000 | Kuo | |
| 6,251,051 | B1 | 6/2001 | Chen | |
| 6,390,958 | B1 * | 5/2002 | Chu | 482/90 |
| 6,398,697 | B1 * | 6/2002 | Nichols, Jr. | 482/87 |
| 6,558,298 | B2 | 5/2003 | Fields et al. | |
| 6,743,157 | B2 | 6/2004 | Hackaday | |
| 6,827,674 | B1 | 12/2004 | Ferry | |
| 6,872,171 | B2 | 3/2005 | Haselrig | |
| 7,390,288 | B2 * | 6/2008 | Giaquinta et al. | 482/85 |
| 7,704,194 | B1 * | 4/2010 | Chen | 482/87 |

(Continued)

*Primary Examiner* — Stephen Crow

*Assistant Examiner* — Garrett Atkinson

(74) *Attorney, Agent, or Firm* — Ariel S. Bentolila; Bay Area IP Group LLC

(57) ABSTRACT

An apparatus includes a first plastic pipe comprising a first end and a second end. A padding surrounds a portion of the first plastic pipe extending from the first end towards the second end. The padding comprises a material for mitigating injuries during striking. A cover encases the padding. A pipe receiver is joined proximate to the second end for grounding motion of the plastic pipe to a structure. The pipe receiver comprises a bracket operable for joining to the structure, and a collar disposed between the bracket and the pipe for mitigating movement of the pipe within the bracket. A concentrically oriented second plastic pipe and third plastic pipe is disposed within the first plastic pipe proximate the second end for mitigating stress on the first plastic pipe proximate the pipe receiver, wherein a strike to the padding flexes the plastic pipe and the plastic pipe springs back.

10 Claims, 6 Drawing Sheets

(56) References Cited

U.S. PATENT DOCUMENTS

| | | | | |
|---|---|---|---|---|
| 8,348,815 | B2 * | 1/2013 | Signorino | 482/83 |
| 2007/0099772 | A1 | 5/2007 | Fu et al. | |
| 2007/0167297 | A1 * | 7/2007 | Stevenson | 482/83 |
| 2008/0096733 | A1 | 4/2008 | Epstein | |
| 2008/0188360 | A1 | 8/2008 | Chu | |
| 2009/0143200 | A1 * | 6/2009 | Hawkersmith | 482/87 |
| 2012/0149534 | A1 * | 6/2012 | Fu et al. | 482/90 |
| 2013/0109541 | A1 * | 5/2013 | Fu et al. | 482/90 |

* cited by examiner

APPARATUS FOR A LIGHTWEIGHT PUNCHING BAG

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The present invention relates generally to a physical fitness apparatus. More particularly, the invention relates to a lightweight and flexible punching bag.

BACKGROUND OF THE INVENTION

Punching bags have been used by people throughout history to train for various different sports and combat purposes such as, but not limited to, military training, martial arts training, fitness training, strength training, training for boxing, etc. Punching bags are designed to be repeatedly hit and to absorb these hits without accumulating much damage. Punching bags are available in many different shapes and sizes, and often comprise a shell made of a durable material such as, but not limited to, leather, canvas, or synthetic material filled with a shock absorbing filler such as, but not limited to, sand, rags, foam, water, air, etc.

A heavy bag is a large punching bag that is typically cylindrical in shape and may be hung from the ceiling by rope or chain or supported on the floor by a stand. Heavy bags are typically used to practice punches and kicks. Traditional boxing heavy bags are very heavy and provide a great deal of resistance. This weight and resistance can cause injuries to users, particularly in the arms from the shoulder through the hand and fingers, and the resistance may prevent people with joint or bone issues from using traditional heavy bags. The heavy weight of traditional heavy bags also makes these bags difficult to pick up, transport and install.

Currently known solutions for reducing injuries caused by the resistance of traditional heavy bags include filling the heavy bags with water and/or adding a soft foam layer to the outside of the heavy bags. However, the weight and inertia exerted by the heavy bag against the arm and hands is still present with these solutions. There are also striking bags that are based on the floor and upright rather than hanging that flex on a spring-like mechanism. However, these bags cannot be permanently anchored and have a weight filled base that is on the floor and gets in the way of the user's feet when punching.

In view of the foregoing, there is a need for improved techniques for providing a large punching bag that is lighter in weight and creates less resistance than traditional heavy bags.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
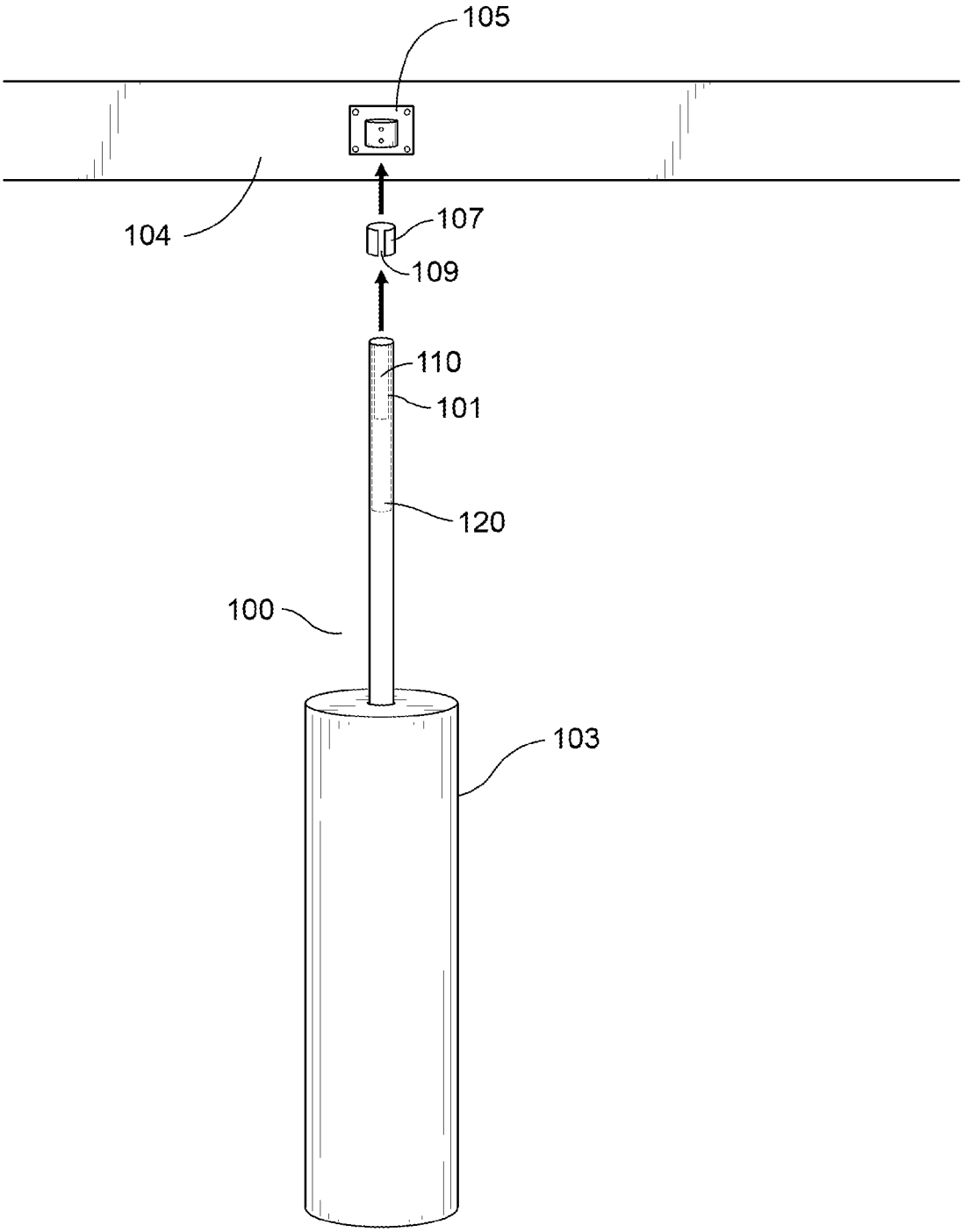
FIG. 1 is a diagrammatic side view of an exemplary lightweight and flexible punching bag, in accordance with an embodiment of the present invention.

Unless otherwise indicated illustrations in the figures are not necessarily drawn to scale.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Detailed descriptions of preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

At least some preferred embodiments of the present invention provide a new type of "heavy bag" or punching bag for activities such as, but not limited to, boxing, martial arts and physical fitness. Instead of using weight to create resistance to punching, at least some preferred embodiments use padding around a flexible plastic pipe. The striking surface in at least some preferred embodiments only moves a short range because of the pipe's limited flexibility yet provides a small amount of resistance compared to a weight-filled heavy bag. One result of this small resistance is that there is less impact on the arms and hands of a user who is punching the bag. This is true while striking at least some preferred embodiments at all levels of power and speed as compared to hitting a heavy bag at the same level. At least some preferred embodiments are lightweight yet flex enough when punched to produce far less resistance on the joints compared to a traditional heavy bag and therefore put less strain on shoulders, arms and hands. This results in less wear and tear on the joints and less injuries and enables a wider variety of people to be able to exercise with at least some preferred embodiments including, but not limited to, children, older people, and people with injuries that prevent them from hitting a traditional heavy bag.

Because at least some preferred embodiments are lighter than traditional heavy bags, they are also easier to ship, carry and set up for the average consumer. Because of the thin diameter of at least some preferred embodiments, a user must execute their punches in a more focused and accurate fashion, aiming for a narrower target. Additionally, because of the quick, short-range movement of at least some preferred embodiments, users must employ timing and speed to use them, which actually helps to increase these skills. This quick, short-range movement, or flexing back and forth, also forces the user to "snap" the punch instead of "pushing" the punch. In "snapping" a punch, the puncher throws a punch and quickly brings the fist back to position. When "pushing" a punch, the fist is not quickly brought back to position. Snapping punches and bringing the fist back to position are fundamentals that are universally taught in martial arts and boxing. The flexing motion of at least some preferred embodiments causes the bag to retract and make contact with the fist if it is left near the bag and not brought back to position. The motion of the bag thereby reminds and conditions users to snap their punches and bring their fists back to position.

FIG. 1 is a diagrammatic side view of an exemplary lightweight and flexible punching bag 100, in accordance with an embodiment of the present invention. In the present embodiment, punching bag 100 comprises a pipe 101 covered with padding 103. Pipe 101 is preferably a four-foot long piece of 1¼" inch, schedule 40 PVC pipe. The length of pipe 101 may vary depending on the height of the ceiling to which punching bag 100 is to be affixed. In alternate embodiments pipes of various different diameters may be used. Furthermore, in alternate embodiments a support other than a plastic pipe may be used such as, but not limited to, tubing made of different materials including, but not limited to, metal, non-circular tubing such as, but not limited to, square tubing or non-tubular supports for example, without limitation, a wooden dowel. However, 1¼-inch, schedule 40, PVC pipe is the preferred material as it provides an amount of resistance that generally minimizes impact on the arm joints while providing an amount of flexibility and movement of the punching surface that supports increased athletic performance. PVC is also ready-made and inexpensive.

In the present embodiment, the bottom of pipe 101 is wrapped in padding 103. Padding 103 is preferably 1-inch thick closed cell foam; however, other types of padding may be used such as, but not limited to, different types of foam, wool or cotton batting, gel material, etc. In the present embodiment, padding 103 preferably extends two feet up from the bottom of pipe 101 and is long enough to wrap around pipe 101 so that padding 103 totals five to nine inches in diameter once wrapped. In alternate embodiments the height and diameter of padding 103 can vary infinitely; however, two feet in height and five to nine inches in diameter is an excellent size for focused punching. In the present embodiment, once padding 103 is wrapped around pipe 101, padding 103 is affixed to itself and pipe 101 by tape or adhesive so it does not unwind. The tightly bound padding 103 can then be encased by a cover made of a durable material such as, but not limited to, leather, canvas, vinyl, etc. Some embodiments may be implemented without a covering around the padding.

In an alternate embodiment that may be mass manufactured, a cylinder of closed cell foam preferably two feet long and five to nine inches in diameter with a center hole slightly narrower than the diameter of the pipe and approximately one foot, nine inches long may be made to snugly fit onto the bottom portion of the pipe. The foam cylinder can then be encased by a leather, canvas or vinyl cover if so desired. The size and dimensions of the foam cylinder may vary. It is also possible to use a variety of different padding materials in a cylindrical shape as a punching surface such as, but not limited to, natural materials or gel materials. Other alternate embodiments may comprise a filler material such as, but not limited to, sand, water or foam pieces contained by a cover rather than a solid piece of padding. Yet other alternate embodiments may use a combination of padding materials.

In the present embodiment, pipe 101 is preferably hung from a ceiling rafter 104 using a pipe receiver. The pipe receiver is firmly secured to the ceiling rafter to mechanically ground the motion of punching bag 100. This is done by inserting the top of pipe 101 into a metal bracket 105 sized to snugly fit around pipe 101. Bracket 105 is screwed or bolted into rafter 104 so padding 103 hangs straight down from rafter 104 when pipe 101 is coupled to bracket 105. Pipe 101 is firmly affixed to rafter 104 and can flex from this attachment point.

In the present embodiment, a metal collar 107, approximately 2½ inches long fits snugly over pipe 101 near the top. Collar 107 may be longer or shorter in alternate embodiments. In the present embodiment, collar 107 effectively fills any space between pipe 101 and the inside diameter of bracket 105. This minimizes any "play", or slight movement, of pipe 101 within bracket 105. Collar 107 has a slice 109 removed, approximately ½ inch wide, along the full length of collar 107 so that the diameter of collar 107 has some flexibility; however, this slice may not be included in some embodiments. In alternate embodiments means other than a metal collar may be used to minimize the play between the pipe and the bracket such as, but not limited to, collars of various different materials, rubber boots, adhesives, etc. Other alternate embodiments may be implemented without these means for minimizing play.

In the present embodiment for added durability, additional pieces of pipe may be inserted into the inside of pipe 101. Preferably, an eighteen-inch length of 1-inch diameter PVC pipe 120 is placed inside pipe 101, near the top, and a nine inch length of ¾-¾" inch inch diameter fiberglass pipe 110 is placed inside the 1-inch diameter pipe, also near the top. This creates stability and strength at the point of greatest vulnerability to stress and breakage, which is the point where pipe 101 flexes against bracket 105. This also disperses the energy of the flex motion gradually down pipe 101 instead of focusing all of the energy on the point where pipe 101 meets bracket 105. In alternate embodiments reinforcement members may be made of various different materials. In other alternate embodiments, reinforcement members may not be included. In some alternate embodiments, the pipe may be made of material that is stronger or more flexible than PVC to reduce stress at this point.

Figure 2:
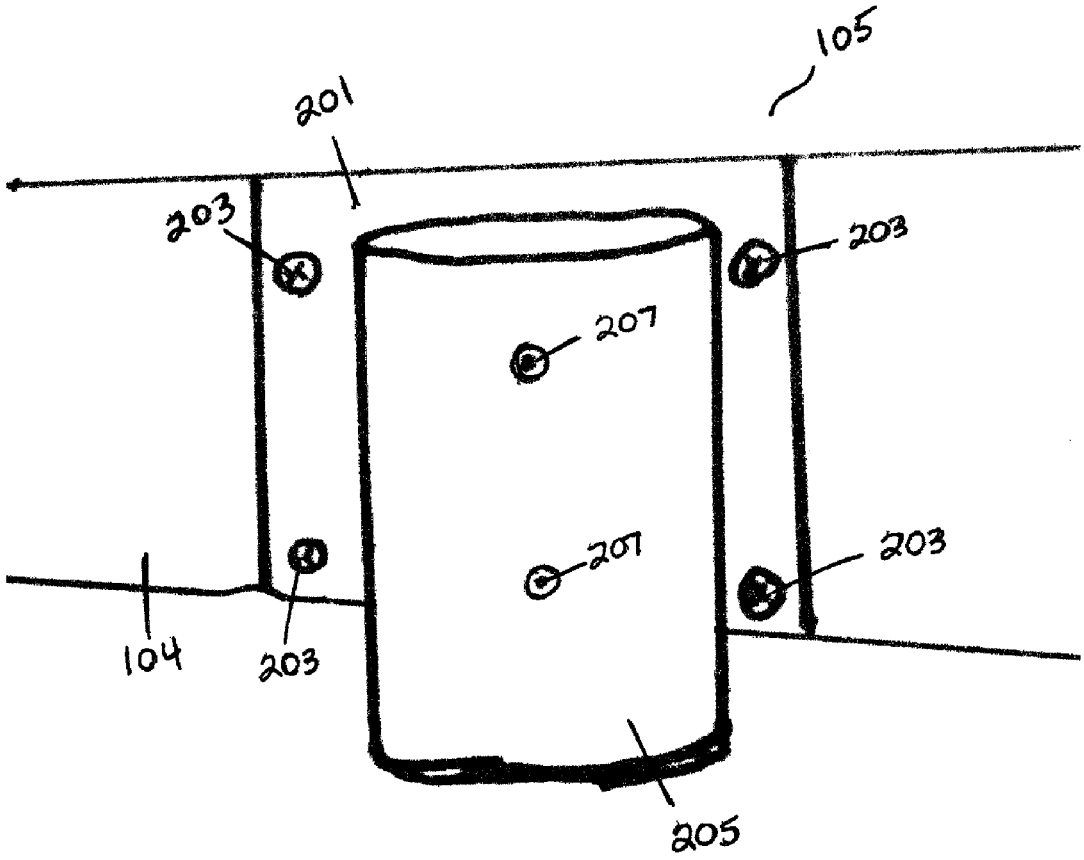
FIG. 2 is a diagrammatic side view of an exemplary bracket for a lightweight and flexible punching bag, in accordance with an embodiment of the present invention.

FIG. 2 is a diagrammatic side view of an exemplary bracket 105 for a lightweight and flexible punching bag, in accordance with an embodiment of the present invention. In the present embodiment, bracket 105 comprises a metal base plate 201 with four screws 203 that attach bracket 105 to a rafter 104 and a circular receiver 205 into which a pipe may be inserted. Receiver 205 is preferably welded to base plate 201. Bracket 105 has two fastening screws 207 that tighten into the pipe to lock the pipe into place so the pipe cannot slide out of receiver 205. In alternate embodiments means other than tightening screws may be used to attach the pipe to the bracket such as, but not limited to, bolts that go through the entire diameter of the pipe, clamps, adhesives, welding, threading, a stoppage plate or cap affixed to the top of the pipe above the bracket, etc. A collar placed between bracket 105 and the pipe, as shown by way of example in FIG. 1, generally prevents tightening screws 207 from digging into the pipe and potentially weakening the PVC. In some embodiments additional support gussets may be used to attach bracket 105 to rafter 104 in order to absorb some of the energy of the flex motion of the pipe.

Those skilled in the art, in light of the present teachings, will readily recognize that a multiplicity of suitable means or pipe receivers exist for securely fastening the pipe of a punching bag according to at least some preferred embodiments to a ceiling rafter so that it hangs vertically. For example, without limitation, a ready-made means to securely fasten the pipe to a ceiling rafter is a "speed rail" fitting, which can be bolted onto the rafter. Once the fitting is bolted onto the rafter, the pipe is inserted into the receiver of the fitting and secured with the two setscrews provided on the receiver. Other non-limiting examples of means that may be used to attach the pipe to a rafter include, but are not limited to, flanges, threaded receivers, clamps, hooks, etc. Furthermore, punching bags according to at least some preferred embodiments may be hung from structures other than ceiling rafters. For example, without limitation, the bag may be hung from a doorframe or from a horizontal surface by a flange. The bag may also be hung from a stand-alone frame. In other alternate embodiments, the bag may be implemented with a stand or base that enables the bag to rest on the floor. In one such embodiment, the padded pipe may be securely anchored to the floor instead of a ceiling so that the bare end of the pipe is firmly attached to a bracket on the floor and the padded end is orientated upward at punching level. In another floor based embodiment, the bare end of the pipe is attached to a pipe receiver mounted on a small piece of plywood. The plywood is bolted onto four rolling casters thereby making the punching bag a rolling target. A push bar may be added to the rolling cart to enable someone to move the rolling cart around while the user hits a moving target. In yet another floor based embodiment, the punching bag may be attached to a base on the floor that does not have wheels.

Figure 3:
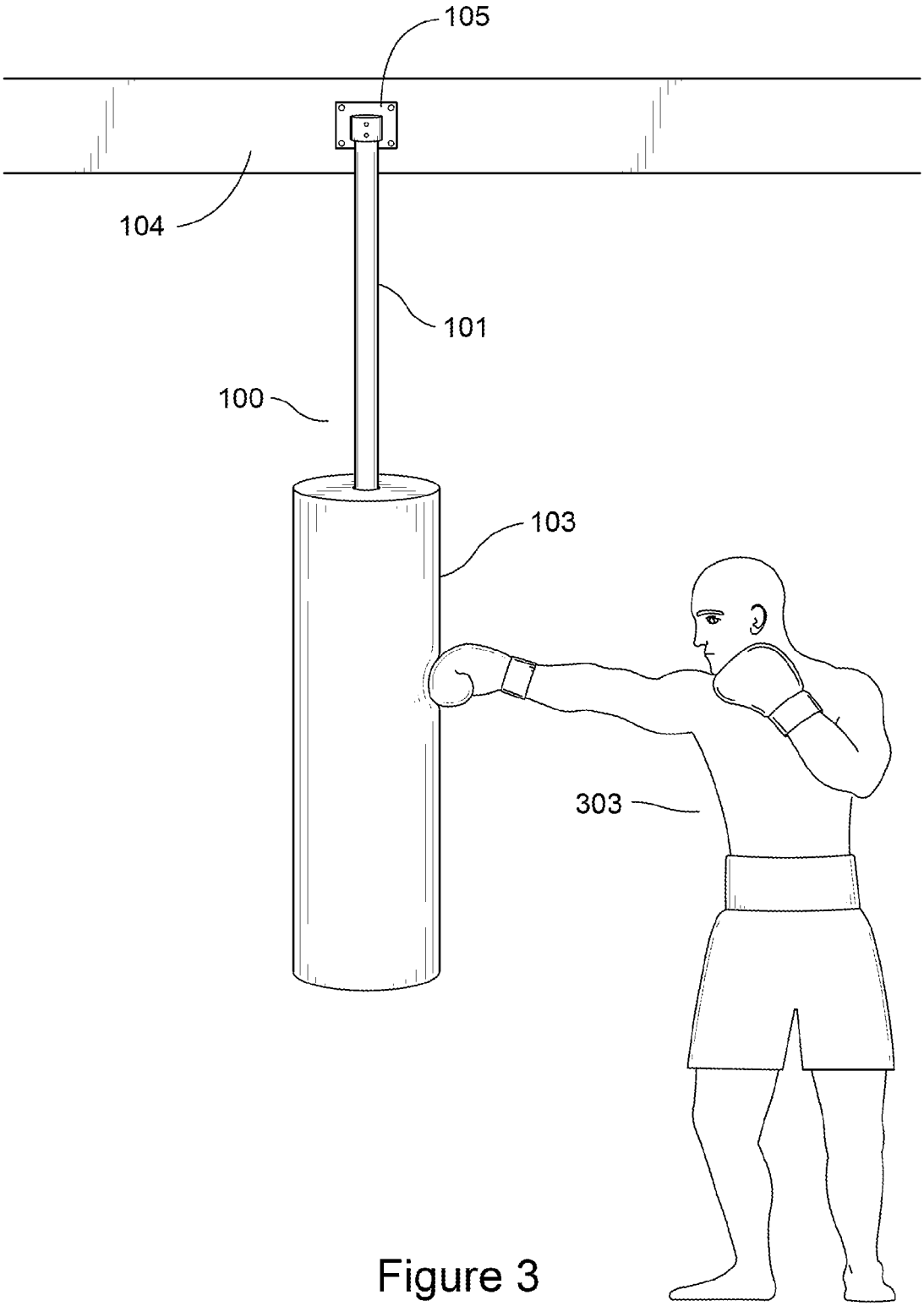
FIG. 3 is a diagrammatic side view of an exemplary lightweight and flexible punching bag in use, in accordance with an embodiment of the present invention.

FIG. 3 is a diagrammatic side view of an exemplary lightweight and flexible punching bag 100 in use, in accordance with an embodiment of the present invention. In typical use of the present embodiment, once punching bag 100 is attached to a ceiling rafter 104 by attaching a pipe 101 to a bracket 105, a user 303 can use a padded area 103 as a target for punching or kicking as one would a traditional "heavy bag". Punching bag 100 is preferably used in an area where user 303 uses it for exercise. This would normally be in an enclosed area with a ceiling; however, this may conceivably be in any area that has something structurally solid overhead to which pipe 101 may be firmly anchored. Most commonly, punching bag 100 is used in a home's basement, attic or garage. Punching bag 100 may also be used in a gym or other type of building or structure.

Figure 4:
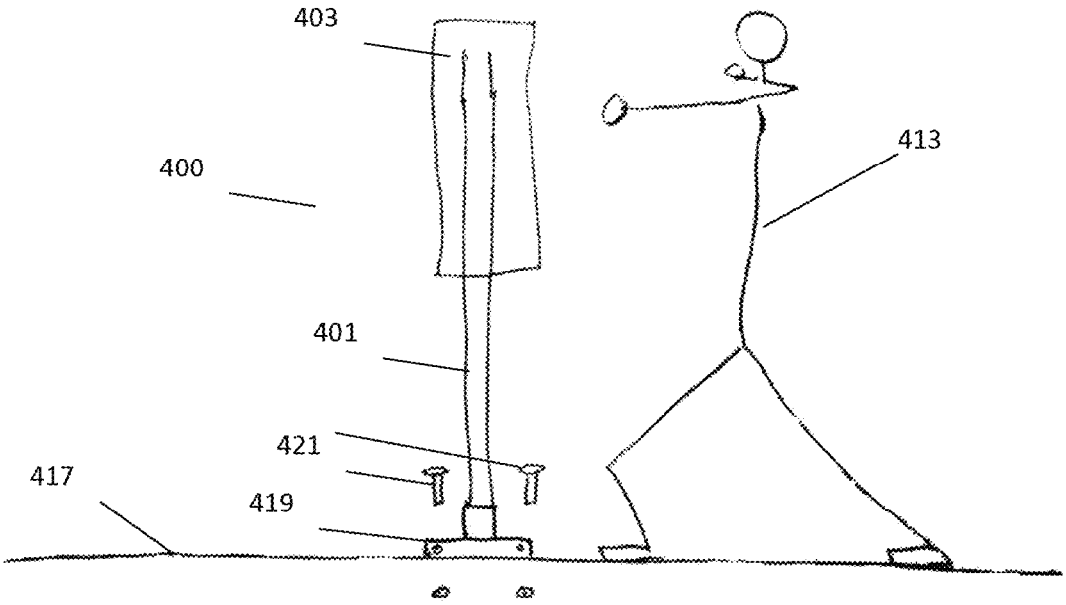
FIG. 4 is a diagrammatic side view of an exemplary floor mounted lightweight and flexible punching bag in use, in accordance with an embodiment of the present invention.

FIG. 4 is a diagrammatic side view of an exemplary floor mounted lightweight and flexible punching bag in use, in accordance with an embodiment of the present invention. Punching bag 400 is similar to punching bag 100 shown in FIG. 1, but has been inverted for floor mounting. A pipe receiver vertically supports punching bag 100 above a horizontal structure. In the present embodiment, base plate or bracket 419 receives pipe 401. Base plate 419 is securely fastened to floor 417 by bolts 421. Other non-limiting examples of means that may be used to fasten base plate 419 to floor 417 include, but are not limited to, flanges, threaded receivers, floor anchors, lag bolts, clamps, hooks, etc. With punching bag 400 securely grounded to floor 417, user 413 may then engage in punching and kicking exercises.

Figure 5:
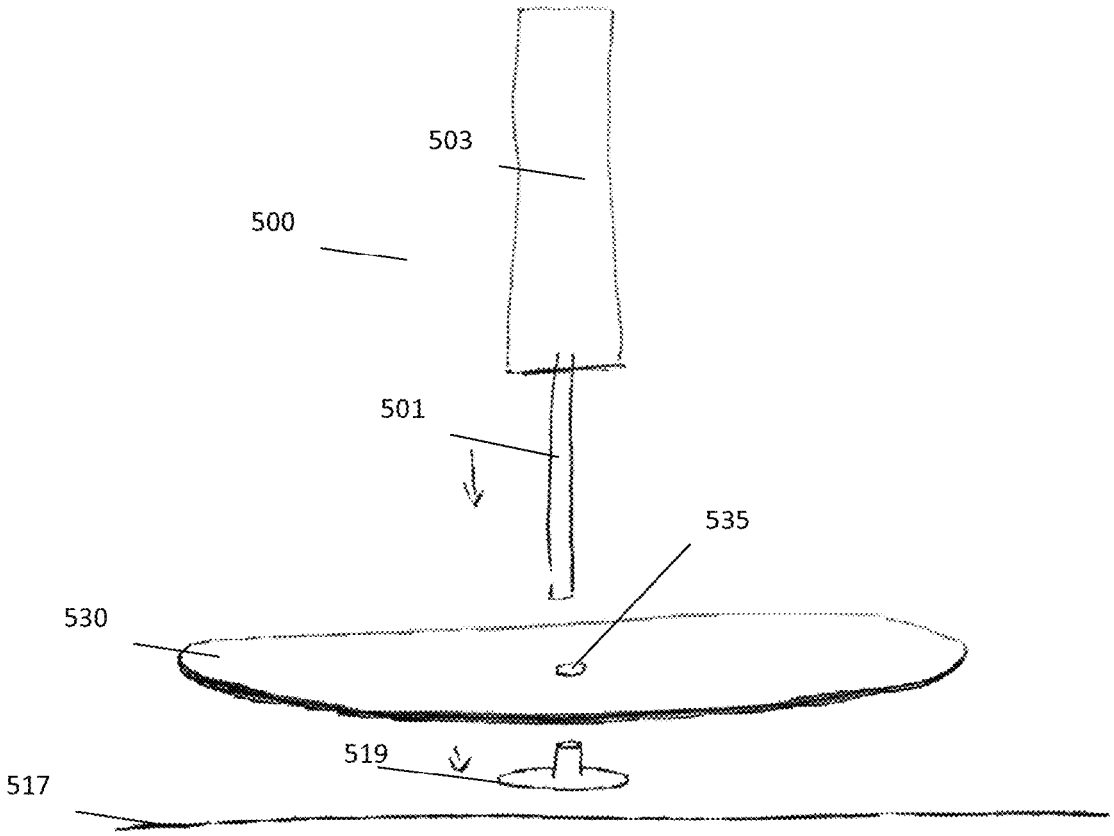
FIG. 5 is a diagrammatic side view of an exemplary floor mounting for a lightweight and flexible punching bag, in accordance with an embodiment of the present invention.

FIG. 5 is a diagrammatic side view of an exemplary floor mounting for a lightweight and flexible punching bag, in accordance with an embodiment of the present invention. This embodiment is similar to that shown in FIG. 4, but differs in that base plate 519 is not fastened to floor 517. In order to mechanically ground punching bag 500, a large piece or pieces of flooring material 530 is placed above and about base plate 519 where the receiving end of base plate 519 protrudes through hole 535. Flooring material 530 is sufficiently large enough for the user to stand on while engaging in punching and kicking exercises. The combined weight of the user and the flooring material 530 grounds the base plate 519 to floor 517.

Figure 6:
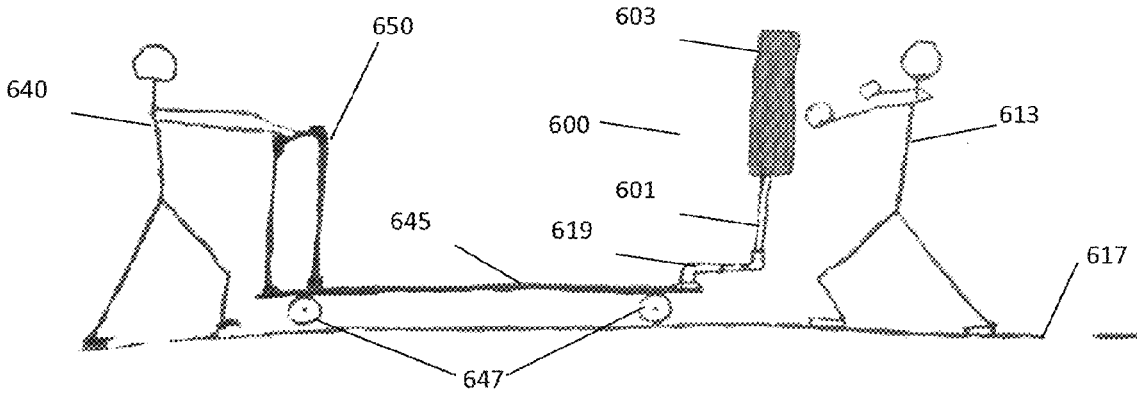
FIG. 6 is a diagrammatic side view of an exemplary movable lightweight and flexible punching bag in use, in accordance with an embodiment of the present invention.

FIG. 6 is a diagrammatic side view of an exemplary movable lightweight and flexible punching bag in use, in accordance with an embodiment of the present invention. In this embodiment, base plate 619 is secured to a movable horizontal structure 645 to mechanically ground punching bag 600 to structure 645. The receiving end of base plate 619 includes two ninety degree bends to position punching bag 600 in front of structure 645. This keeps the feet of user 613 from potentially bumping into structure 645. In the present embodiment caster wheels 647 enable structure 645 to be moved about floor 617. Other non-limiting examples of means to enable structure 645 to move include, but are not limited to, fixed position wheels, fixed axel wheels, floor rollers, inflatable tires, etc. Push bar 650 is joined to the back end of structure 645 to enable a helper 640 to move punching bag 600 about floor 617 to provide additional training exercises for user 613. Other non-limiting examples of means to move structure 645 include, but are not limited to, a fixed pole, a pole on axes for rotation, a rope, a steering means for the rear wheels, etc.

Having fully described at least one embodiment of the present invention, other equivalent or alternative methods of providing a lightweight and flexible punching bag according to the present invention will be apparent to those skilled in the art. The invention has been described above by way of illustration, and the specific embodiments disclosed are not intended to limit the invention to the particular forms disclosed. For example, the particular implementation of the bracket may vary depending upon the particular type of pipe used. The pipes described in the foregoing were directed to round implementations; however, similar techniques are to use pipes or tubing of various different shapes including, but not limited to, square or triangular tubing and to provide brackets in corresponding shapes. Implementations of the present invention that do not use round pipes are contemplated as within the scope of the present invention. The invention is thus to cover all modifications, equivalents, and alternatives falling within the spirit and scope of the following claims.

Claim elements and steps herein may have been numbered and/or lettered solely as an aid in readability and understanding. Any such numbering and lettering in itself is not intended to and should not be taken to indicate the ordering of elements and/or steps in the claims

What is claimed is:

1. An apparatus consisting of:

a first pipe implement, said first pipe comprises a substantially flexible pipe having a predetermined diameter, in which said first pipe further comprises a first end section and a second end section, wherein said first pipe further comprises a unitary pipe having a predetermined length and a predetermined outer diameter, in which said first end section comprises a proximate bottom portion and said second end comprises a proximate top portion, and in which said top portion comprises a proximate topmost section configured to engage with a bracket device;

a padding implement, said padding implement comprising a cell foam cylinder, wherein said padding implement is disposed proximately at said bottom portion of said first pipe implement and generally wraps around said bottom portion, and wherein said padding implement generally extends from said bottom portion towards said top portion, in which said padding further comprises a material for generally mitigating injuries during a striking practice by a user, said padding implement further comprising a center hole being configured to fit onto said bottom portion of said first pipe implement;

a means for grounding motion of said second end of said first pipe to a structure, said structure comprising a ceiling structure, in which said injury mitigating means hangs straight down from said ceiling structure, whereby a strike to said mitigating means substantially flexes said first pipe from a first position and said first pipe substantially springs back to said first position;

a means for mitigating movement of said second end of said first pipe from said motion grounding means, said movement mitigating means substantially preventing fasteners from digging into said first pipe; and a means for mitigating stress on said first pipe proximate said grounding means, wherein said stress mitigating means substantially creates stability and strength at a flexing point of said first pipe.

2. An apparatus comprising:

a first pipe implement, said first pipe comprising a first end and a second end, wherein said first pipe further comprises a flexible pipe having a proximate predetermined diameter, and wherein said first pipe further comprises a unitary pipe having a predetermined length and a predetermined outer diameter, in which said first end comprises a proximate bottom portion of said first pipe and said second end comprises a proximate top portion of said first pipe, and in which said top portion comprises a proximate topmost section configured to engage with a bracket device;

a padding implement, said padding implement comprising a cell foam cylinder, wherein said padding implement is disposed proximately at said bottom portion of said first pipe implement and generally wraps around said bottom portion, and wherein said padding implement generally extends from said bottom portion towards said top portion, in which said padding further comprising a material for generally mitigating injuries during a striking practice by a user;

a pipe receiver mechanism, said pipe receiver comprising a bracket device secured to a ceiling structure, wherein said bracket device is configured to engage with said top portion of said first pipe by inserting said topmost section of said top portion into said bracket device, thereby, said padding hangs straight down from said ceiling structure when said topmost section of said top portion of said first pipe is coupled to said bracket device, wherein said bracket device is further configured to generally minimize motion of said first pipe to said ceiling structure, and wherein a strike to said padding generally flexes said first pipe from a first position and said first pipe generally springs back to said first position;

an insert mechanism, said insert mechanism comprising a second pipe implement having a predetermined length and a center hole with a predetermined diameter, in which said insert mechanism further comprises a third pipe implement, wherein said second pipe is approximately twice the length of said third pipe, and wherein said third pipe is disposed within a top portion of said second pipe, in which said second pipe and third pipe is configured to be disposed within said first pipe proximate said topmost section of said top portion for substantially mitigating stress on said first pipe proximate said pipe receiver, and in which said insert mechanism is configured to broadly create stability and strength at approximately a point of vulnerability to stress and breakage, wherein said point of vulnerability is where said first pipe generally flexes against said bracket device; and said pipe receiver mechanism further comprising a collar device having a proximate center hole with a predetermined diameter configured to accept the topmost section of said top portion of said first pipe implement, wherein said collar device is configured to generally minimize movement of said topmost section of said top portion of said first pipe implement within said bracket device.

3. The apparatus as recited in claim 2, in which said padding implement further comprises a cover for substantially encasing said padding implement, in which said padding implement further comprises a closed cell foam cylinder of approximately two feet in length and at least five to nine inches in diameter, and in which said padding further comprising a center hole configured to fit onto said bottom portion of said first pipe implement.

4. The apparatus as recited in claim 2, in which said bracket device further comprises a base plate with at least four screws that substantially attaches said bracket device to said ceiling structure, and in which said bracket device further comprises a circular receiver into which said topmost section of said first pipe is inserted, wherein said circular receiver is welded to said base plate.

5. The apparatus as recited in claim 2, in which said padding implement further comprises an approximately one inch thick closed cell foam cylinder, and in which said padding implement further comprises an approximately one foot and nine inches to two feet in length cell foam configured to fit onto said bottom portion of said first pipe, and in which said ceiling structure is an overhead doorframe or an overhead stand-alone frame onto which said apparatus is engaged.

6. The apparatus as recited in claim 2, wherein said collar device comprises a removed slice along a length of said collar operable to enable a diameter adjustment with said topmost section of said top portion of said first pipe.

7. The apparatus as recited in claim 2, wherein said topmost section of said top portion of said first pipe is threaded, and wherein said pipe receiver mechanism is a threaded pipe receiver mechanism, in which said pipe receiver further comprising a base plate being operable for substantially supporting said pipe generally vertically above a generally horizontal structure.

8. The apparatus as recited in claim 2, wherein said first pipe further comprises a square or triangular tubing implement, and wherein said pipe receiver mechanism and said insert mechanism is configured to match a shape of said square or triangular tubing implement.

9. An apparatus comprising:

a first pipe implement, said first pipe comprising a first end and a second end, wherein said first pipe further comprises a flexible pipe having a proximate predetermined diameter, and wherein said first pipe further comprising a unitary pipe having a predetermined length and a predetermined outer diameter, in which said first end comprises a proximate bottom portion of said first pipe and said second end comprises a proximate top portion of said first pipe, and in which said top portion comprises a proximate topmost section configured to engage with a bracket device;

a padding implement, said padding implement comprising a cell foam, wherein said padding implement is disposed proximately at said bottom portion and generally wraps around said bottom portion of said first pipe, and wherein said padding implement generally extends from said bottom portion towards said top portion, in which said padding further comprises a material for substantially mitigating injuries during striking practice by a user;

said padding implement further comprising a center hole being configured to fit onto said bottom portion of said first pipe implement;

a cover for substantially encasing said padding;

a pipe receiver mechanism, said pipe receiver comprising a bracket device secured to a ceiling structure, wherein said bracket device is configured to engage with said top portion of said first pipe implement by inserting said topmost section of said top portion into said bracket device, thereby, said padding hangs straight down from said ceiling structure when said topmost section of said top portion of said first pipe is coupled to said bracket device, wherein said bracket device is further configured for substantially grounding motion of said first pipe implement to said ceiling structure;

a collar device, said collar device having a proximate center hole with a predetermined diameter configured to accept the topmost section of said top portion of said first pipe implement, wherein said collar device is disposed generally between said bracket and said first pipe for substantially mitigating movement of said plastic pipe within said bracket device, wherein said collar comprises a substantially removed slice along a length of said collar for substantially enabling a diameter adjustment; and an insert mechanism, said insert mechanism comprising a second pipe implement having a predetermined length and a center hole with a predetermined diameter, in which said insert mechanism further comprises a third pipe implement, wherein said second pipe is approximately twice the length of said third pipe, and wherein said third pipe is disposed within a proximate top portion of said second pipe, in which said second pipe and third pipe is configured to be disposed proximate within said topmost section of said top portion of said first pipe implement, and in which said insert mechanism is configured to broadly create stability and strength at approximately a point of vulnerability to stress and breakage, wherein said point of vulnerability is where said first pipe generally flexes against said bracket device.

10. The apparatus as recited in claim 9, in which said padding implement further comprises an approximately one inch thick closed cell foam cylinder, and in which said padding further comprising approximately one foot and 9 inches to two feet in length cylinder fitted onto said bottom portion of said first pipe implement.

* * * * *